US006466190B1

(12) United States Patent
Evoy

(10) Patent No.: US 6,466,190 B1
(45) Date of Patent: Oct. 15, 2002

(54) FLEXIBLE COLOR MODULATION TABLES OF RATIOS FOR GENERATING COLOR MODULATION PATTERNS

(75) Inventor: David R. Evoy, Tempe, AZ (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 239 days.

(21) Appl. No.: 09/596,923

(22) Filed: Jun. 19, 2000

(51) Int. Cl.[7] ..... G09G 3/36

(52) U.S. Cl. ..... 345/89; 345/602; 345/87; 345/88

(58) Field of Search ..... 345/87–89, 99, 345/691, 600–604

(56) References Cited

U.S. PATENT DOCUMENTS

| | | | | |
|---|---|---|---|---|
| 5,196,839 A | | 3/1993 | Johary et al. | 340/793 |
| 5,313,224 A | * | 5/1994 | Singhal et al. | 345/89 |
| 5,400,044 A | | 3/1995 | Thomas | 345/147 |
| 5,861,869 A | * | 1/1999 | Scheffer et al. | 345/691 |
| 5,867,137 A | | 2/1999 | Sugiyama | 345/89 |
| 6,288,698 B1 | * | 9/2001 | Ishii et al. | 345/87 |

* cited by examiner

*Primary Examiner*—Kent Chang
*Assistant Examiner*—Tom V Sheng
(74) *Attorney, Agent, or Firm*—Peter Zawilski

(57) ABSTRACT

A method for providing intensity modulation for a display of an electronic device. The method uses tables of ratios for generating color modulation patterns. The method includes the step of defining a table of intensity values with each intensity value including a respective on-ratio and a respective off-ratio. A pixel intensity for a pixel of a display is selected by selecting a corresponding intensity value in the table. The pixel intensity is implemented by using an accumulator having an output for determining whether the pixel is on or off, wherein the pixel is on for zero and for positive values of the output and off for negative values of the output. The output is used to implement a duty cycle for the pixel, by turning the pixel on and off. The duty cycle is implemented by setting an initial output of the accumulator. The output is subsequently set to a value equal to the output minus the off-ratio if the pixel is on, and setting the output to the output plus the on-ratio if the pixel is off. Successively turning the pixel on and off in accordance with the output thereby implements a duty cycle for the pixel according to the on-ratio and off-ratio of the intensity value.

20 Claims, 6 Drawing Sheets

300

| COLOR A | | COLOR B | | COLOR C | | COLOR D | | COLOR E | | COLOR F | |
|---|---|---|---|---|---|---|---|---|---|---|---|
| ONR | 1 | ONR | 5 | ONR | 5 | ONR | 7 | ONR | 1 | ONR | 15 |
| OFFR | 2 | OFFR | 6 | OFFR | 6 | OFFR | 11 | OFFR | 11 | OFFR | 4 |
| PERIOD | 3 | | 11 | | 11 | | 18 | | 12 | | 19 |
| ACCUM | PIXEL | ACCUM | PIXEL | ACCUM | PIXEL | ACCUM | PIXEL | ACCUM | PIXEL | ACCUM | PIXEL |
| 0 | ON | 0 | ON | 0 | ON | 0 | ON | 0 | ON | 0 | ON |
| -2 | OFF | -5 | OFF | -6 | OFF | -11 | OFF | -11 | OFF | -4 | OFF |
| -1 | OFF | 1 | ON | -1 | OFF | -4 | OFF | -10 | OFF | 11 | ON |
| 0 | ON | -4 | OFF | 4 | ON | 3 | ON | -9 | OFF | 7 | ON |
| -2 | OFF | 2 | ON | -2 | OFF | -8 | OFF | -8 | OFF | 3 | ON |
| -1 | OFF | -3 | OFF | 3 | ON | -1 | OFF | -7 | OFF | -1 | OFF |
| 0 | ON | 3 | ON | -3 | OFF | 6 | ON | -6 | OFF | 14 | ON |
| -2 | OFF | -2 | OFF | 2 | ON | -5 | OFF | -5 | OFF | 10 | ON |
| -1 | OFF | 4 | ON | -4 | OFF | 2 | ON | -4 | OFF | 6 | ON |
| 0 | ON | -1 | OFF | 1 | ON | -9 | OFF | -3 | OFF | 2 | ON |
| -2 | OFF | 5 | ON | -5 | OFF | -2 | OFF | -2 | OFF | -2 | OFF |
| -1 | OFF | 0 | ON | 0 | ON | 5 | ON | -1 | OFF | 13 | ON |
| 0 | ON | -5 | OFF | -6 | OFF | -6 | OFF | 0 | ON | 9 | ON |
| -2 | OFF | 1 | ON | -1 | OFF | 1 | ON | -11 | OFF | 5 | ON |
| -1 | OFF | -4 | OFF | 4 | ON | -10 | OFF | -10 | OFF | 1 | ON |
| 0 | ON | 2 | ON | -2 | OFF | -3 | OFF | -9 | OFF | -3 | OFF |
| -2 | OFF | -3 | OFF | 3 | ON | 4 | ON | -8 | OFF | 12 | ON |
| -1 | OFF | 3 | ON | -3 | OFF | -7 | OFF | -7 | OFF | 8 | ON |
| 0 | ON | -2 | OFF | 2 | ON | 0 | ON | -6 | OFF | 4 | ON |
| -2 | OFF | 4 | ON | -4 | OFF | -11 | OFF | -5 | OFF | 0 | ON |
| -1 | OFF | -1 | OFF | 1 | ON | -4 | OFF | -4 | OFF | -4 | OFF |
| 0 | ON | 5 | ON | -5 | OFF | 3 | ON | -3 | OFF | 11 | ON |
| -2 | OFF | 0 | ON | 0 | ON | -8 | OFF | -2 | OFF | 7 | ON |
| -1 | OFF | -5 | OFF | -6 | OFF | -1 | OFF | -1 | OFF | 3 | ON |
| 0 | ON | 1 | ON | -1 | OFF | 6 | ON | 0 | ON | -1 | OFF |
| -2 | OFF | -4 | OFF | 4 | ON | -5 | OFF | -11 | OFF | 14 | ON |
| -1 | OFF | 2 | ON | -2 | OFF | 2 | ON | -10 | OFF | 10 | ON |
| 0 | ON | -3 | OFF | 3 | ON | -9 | OFF | -9 | OFF | 6 | ON |
| -2 | OFF | 3 | ON | -3 | OFF | -2 | OFF | -8 | OFF | 2 | ON |
| -1 | OFF | -2 | OFF | 2 | ON | 5 | ON | -7 | OFF | -2 | OFF |
| 0 | ON | 4 | ON | -4 | OFF | -6 | OFF | -6 | OFF | 13 | ON |
| -2 | OFF | -1 | OFF | 1 | ON | 1 | ON | -5 | OFF | 9 | ON |
| -1 | OFF | 5 | ON | -5 | OFF | -10 | OFF | -4 | OFF | 5 | ON |
| 0 | ON | 0 | ON | 0 | ON | -3 | OFF | -3 | OFF | 1 | ON |
| -2 | OFF | -5 | OFF | -6 | OFF | 4 | ON | -2 | OFF | -3 | OFF |
| -1 | OFF | 1 | ON | -1 | OFF | -7 | OFF | -1 | OFF | 12 | ON |
| 0 | ON | -4 | OFF | 4 | ON | 0 | ON | 0 | ON | 8 | ON |
| -2 | OFF | 2 | ON | -2 | OFF | -11 | OFF | -11 | OFF | 4 | ON |
| -1 | OFF | -3 | OFF | 3 | ON | -4 | OFF | -10 | OFF | 0 | ON |
| 0 | ON | 3 | ON | -3 | OFF | 3 | ON | -9 | OFF | -4 | OFF |
| -2 | OFF | -2 | OFF | 2 | ON | -8 | OFF | -8 | OFF | 11 | ON |
| -1 | OFF | 4 | ON | -4 | OFF | -1 | OFF | -7 | OFF | 7 | ON |
| 0 | ON | -1 | OFF | 1 | ON | 6 | ON | -6 | OFF | 3 | ON |
| -2 | OFF | 5 | ON | -5 | OFF | -5 | OFF | -5 | OFF | -1 | OFF |

FIG. 3

| FRACTION | % ON | FRACTION | % ON | FRACTION | % ON | FRACTION | % ON |
|---|---|---|---|---|---|---|---|
| 1/32 | 3.13% | 5/32 | 15.63% | 3/10 | 30.00% | 11/25 | 44.00% |
| 1/31 | 3.23% | 3/19 | 15.79% | 7/23 | 30.43% | 12/27 | 44.44% |
| 1/30 | 3.33% | 4/25 | 16.00% | 4/13 | 30.77% | 8/18 | 44.44% |
| 1/29 | 3.45% | 5/31 | 16.13% | 9/29 | 31.03% | 13/29 | 44.83% |
| 1/28 | 3.57% | 1/6 | 16.67% | 5/16 | 31.25% | 9/20 | 45.00% |
| 1/27 | 3.70% | 5/29 | 17.24% | 6/19 | 31.58% | 14/31 | 45.16% |
| 1/26 | 3.85% | 4/23 | 17.39% | 7/22 | 31.82% | 5/11 | 45.45% |
| 1/25 | 4.00% | 3/17 | 17.65% | 8/25 | 32.00% | 11/24 | 45.83% |
| 1/24 | 4.17% | 5/28 | 17.86% | 9/28 | 32.14% | 6/13 | 46.15% |
| 1/23 | 4.35% | 4/22 | 18.18% | 10/31 | 32.26% | 13/28 | 46.43% |
| 1/22 | 4.55% | 5/27 | 18.52% | 1/3 | 33.33% | 7/15 | 46.67% |
| 1/21 | 4.76% | 3/16 | 18.75% | 11/32 | 34.38% | 15/32 | 46.88% |
| 1/20 | 5.00% | 4/21 | 19.05% | 10/29 | 34.48% | 8/17 | 47.06% |
| 1/19 | 5.26% | 5/26 | 19.23% | 9/26 | 34.62% | 9/19 | 47.37% |
| 1/18 | 5.56% | 6/31 | 19.35% | 8/23 | 34.78% | 10/21 | 47.62% |
| 1/17 | 5.88% | 1/5 | 20.00% | 7/20 | 35.00% | 11/23 | 47.83% |
| 2/32 | 6.25% | 6/29 | 20.69% | 6/17 | 35.29% | 12/25 | 48.00% |
| 2/31 | 6.45% | 5/24 | 20.83% | 11/31 | 35.48% | 13/27 | 48.15% |
| 1/15 | 6.67% | 4/19 | 21.05% | 5/14 | 35.71% | 14/29 | 48.28% |
| 2/29 | 6.90% | 3/14 | 21.43% | 9/25 | 36.00% | 15/31 | 48.39% |
| 1/14 | 7.14% | 5/23 | 21.74% | 4/11 | 36.36% | 1/2 | 50.30% |
| 2/27 | 7.41% | 7/32 | 21.88% | 11/30 | 36.67% | | |
| 1/13 | 7.69% | 2/9 | 22.22% | 7/19 | 36.84% | | |
| 2/25 | 8.00% | 7/31 | 22.58% | 10/27 | 37.04% | | |
| 1/12 | 8.33% | 5/22 | 22.73% | 12/32 | 37.50% | | |
| 2/23 | 8.70% | 3/13 | 23.08% | 3/8 | 37.50% | | |
| 1/11 | 9.09% | 7/30 | 23.33% | 11/29 | 37.93% | | |
| 3/32 | 9.38% | 4/17 | 23.53% | 8/21 | 38.10% | | |
| 2/21 | 9.52% | 5/21 | 23.81% | 5/13 | 38.46% | | |
| 3/31 | 9.68% | 6/25 | 24.00% | 12/31 | 38.71% | | |
| 1/10 | 10.00% | 7/29 | 24.14% | 7/18 | 38.89% | | |
| 3/29 | 10.34% | 1/4 | 25.00% | 9/23 | 39.13% | | |
| 2/19 | 10.53% | 8/31 | 25.81% | 11/28 | 39.29% | | |
| 3/28 | 10.71% | 7/27 | 25.93% | 2/5 | 40.00% | | |
| 1/9 | 11.11% | 6/23 | 26.09% | 13/32 | 40.63% | | |
| 3/26 | 11.54% | 5/19 | 26.32% | 11/27 | 40.74% | | |
| 2/17 | 11.76% | 4/15 | 26.67% | 9/22 | 40.91% | | |
| 3/25 | 12.00% | 7/26 | 26.92% | 7/17 | 41.18% | | |
| 1/8 | 12.50% | 3/11 | 27.27% | 12/29 | 41.38% | | |
| 4/31 | 12.90% | 8/29 | 27.59% | 5/12 | 41.67% | | |
| 3/23 | 13.04% | 5/18 | 27.78% | 13/31 | 41.94% | | |
| 2/15 | 13.33% | 7/25 | 28.00% | 8/19 | 42.11% | | |
| 3/22 | 13.64% | 9/32 | 28.13% | 11/26 | 42.31% | | |
| 4/29 | 13.79% | 2/7 | 28.57% | 3/7 | 42.86% | | |
| 1/7 | 14.29% | 9/31 | 29.03% | 13/30 | 43.33% | | |
| 4/27 | 14.81% | 7/24 | 29.17% | 10/23 | 43.48% | | |
| 3/20 | 15.00% | 5/17 | 29.41% | 14/32 | 43.75% | | |
| 2/13 | 15.38% | 8/27 | 29.63% | 7/16 | 43.75% | | |

FIG. 4

FLEXIBLE COLOR MODULATION TABLES OF RATIOS FOR GENERATING COLOR MODULATION PATTERNS

TECHNICAL FIELD

The present invention relates generally to displays electronic devices. More particularly, the present invention relates to a method and system for providing a wide range of colors and consistent color depth in a digital display.

BACKGROUND ART

Many electronic devices include functionality for providing interaction with a user via a display screen. In such devices, the display screen provides much of the information about the state of the device and is used to communicate output information to the user. Display screens typically are able to provide a greater variety and depth of information than other types of output devices (e.g., LED lights, printouts, etc.).

With modern electronic devices, the trend is to incorporate more input and output functions between the device and the user through the use of a rich visual display. One such example is the modern personal digital assistant (PDA) or cellphone. Many of these displays are using color to provide a richer user interface and to provide a richer range of output types. The most popular types of displays for such devices are LCD displays (liquid crystal display).

LCD displays are popular for, among many reasons, their small size, lightweight, and form factor (e.g., being flat). LCD displays are found in a large range of devices. Such devices include, for example, laptop computer systems, PDAs, cellphones, and the like. Color LCD displays capable of displaying a full range (or palette) of colors have proven to be very popular.

Generally, there are two basic types of LCD displays, active LCD displays and passive LCD displays. The active and passive LCD displays come in both color and black and white (e.g., gray scale) types. Active LCD displays are typically more expensive although they are capable of displaying higher intensity gray scales and colors, and are thus generally used in higher end electronic devices (e.g., laptop computers). Passive LCD displays are less expensive, and are thus more readily incorporated into a wider range of electronic devices (e.g., PDAs, cellphones, set-top boxes, etc.).

With respect to passive LCD displays, there exists a problem wherein the refresh patterns of the passive LCD display causes noticeable artifacts/interference for the user viewing the display. There are many different variables which interact with the passive LCD display to create such artifacts/interference. One such variable is interference from localized light sources. For example, typical overhead fluorescent lights (e.g., as found in many offices) tend to flicker in response to the frequency of the AC power of the building (e.g., 60 hertz). This 60 hertz flickering of the overhead lights can interfere with the refresh rate of the passive LCD display. The interference is visible in the form of a flickering of the LCD display as seen by the human eye, or by the shimmering or flashing of certain colors on the LCD display.

The problem of interference tends to limit the total number of colors and color depths the LCD is able to display. It is advantageous to implement a color display that uses a very large palette of colors and color depths, allowing the creation of very rich user interfaces and output formats. However, the refresh patterns used to create many of the different color combinations/depths cause noticeable artifacts. Some color combinations are especially prone to interference with the environmental lighting conditions.

In the prior art, device engineers have attempted to design around this problem by tuning the color combination refresh rates and the LCD display with respect to particular lighting conditions in use throughout most environments (e.g., the 60 hertz flicker rate of office overhead fluorescent lights). The many variables and characteristics affecting a particular LCD display are analyzed and designed to avoid interference problems as best as possible when used in the most common lighting environments. Unfortunately, the solution is not effective when the display is used in environments other than those to which the LCD display has been optimized, such as, for example, those environments which have lighting at frequencies other than 60 hertz, such as Europe, where lights flicker at 50 hertz.

The environmental lighting interference problem is a particular concern for passive color LCD displays. Due to the nature in which colors are generated on passive LCD displays, different colors and different color intensities on the display flicker at different frequencies. These different frequencies, in the presence of interfering environmental lights, cause certain colors of the passive LCD display to show interference artifacts. For example, certain hues and shades would appear to shimmer or flicker to a human observer. Generally speaking, this is due to the fact that with the passive color LCD displays, pixel elements are modulated in an on-off manner (turning pixel elements on and off) in order to emulate different depths of intensity. The pixel elements are turned on and off at different frequencies in order to effect different intensities. It is this nature of intensity modulation which causes particular interference problems for passive LCD displays, both color displays and gray scale displays.

For example, where overhead lights flicker at 60 hertz and a display flickers at 59 hertz, there will occur once per second an intensity "pulse" where the intensity of the overhead lights and the intensity of the passive LCD display will constructively interfere. This can be quite annoying to a human viewer.

Thus, the constructive and destructive interference between the environmental lighting conditions and the LCD refresh rate becomes a substantial limiter in the manner in which intensities can be modulated. In the prior art, custom intensity modulation algorithms were developed specific to environmental lighting conditions where a passive LCD display was expected to operate. The algorithms used intensity modulation schemes to yield as large a color palette as possible while avoiding those particularly observable interference patterns visible to the human eye.

However, the shortcomings of these solutions was the fact that the algorithms were specific to the lighting environment and specific to the particular type of passive LCD display. When the lighting environment changes, there is no guarantee that the annoying and observable interference patterns will not return. For example, an LCD touchscreen device being designed for lighting environments in Europe is not optimized for the lighting environments of North America. Additionally, when an electronic device is altered by using an LCD screen from a different manufacture, there would be no guarantee that the annoying and observable interference patterns would not return.

Thus, what is required is a method and system for modulating intensity of a passive LCD display which avoids the objectionable interference patterns caused by environmental lighting conditions. What is required is a solution that can readily implemented with different types of passive LCD displays from different manufacturers. What is required is a solution that is readily adaptable to different environmental lighting conditions. Additionally, the required solution should provide a large color palette while avoiding those particularly observable interference patterns visible to human eye. The present invention provides a novel solution to the above requirements.

DISCLOSURE OF THE INVENTION

The present invention provides a method and system for modulating intensity of a passive LCD display which avoids the objectionable interference patterns caused by environmental lighting conditions. The present invention provides a solution that can readily control different types of passive LCD displays from different manufacturers. The present invention provides a solution that is readily adaptable to different environmental lighting conditions. Additionally, the present invention provides a large color palette while avoiding those particularly observable interference patterns visible to human eye.

In one embodiment, the present invention is implemented as a method for providing intensity modulation for a display of an electronic device. The method uses tables of ratios for generating color modulation patterns. The method includes the step of defining a table of intensity values with each intensity value including a respective on-ratio and a respective off-ratio. A pixel intensity for a pixel of a display is selected by selecting a corresponding intensity value in the table. The pixel intensity is implemented by using an accumulator having an output for determining whether the pixel is on or off, wherein the pixel is on for zero and for positive values of the output and off for negative values of the output. The output is used to implement a duty cycle for the pixel, by turning the pixel on and off. The duty cycle is implemented by setting an initial output of the accumulator. The output is subsequently set to a value equal to the output minus the off-ratio if the pixel is on, and setting the output to the output plus the on-ratio if the pixel is off. Successively turning the pixel on and off in accordance with the output thereby implements a duty cycle for the pixel according to the on-ratio and off-ratio of the intensity value.

Thus, the programmable nature of the table of ratios provides a solution having a large color palette while avoiding those particularly observable interference patterns visible to human eye, and a solution that can readily control different types of passive LCD displays from different manufacturers. For example, when an electronic device is modified to use a passive LCD display from a different manufacture, hardware of the color modulator need not be altered. The ratios of the table can be readily reprogrammed to account for the characteristics of the new passive LCD display. Similarly, the table of ratios provides a solution that is readily adaptable to different environmental lighting conditions. For example, a manufacture need not produce custom versions of an electronic device for selling in different markets around the world. A global manufacturer can standardize the electronic devices, secure in the knowledge that different lighting environments in different markets around the world can be readily accounted for by reprogramming the ratios in the table.

BRIEF DESCRIPTION OF THE DRAWINGS

The accompanying drawings, which are incorporated in and form a part of this specification, illustrate embodiments of the invention and, together with the description, serve to explain the principles of the invention:

FIG. 3 shows a diagram of a table of intensity values in accordance with one embodiment of the present invention.

FIG. 4 shows a diagram of a table of intensity values in accordance with an embodiment of the present invention wherein the intensity values include respective periods in addition to on-off ratios.

BEST MODE FOR CARRYING OUT THE INVENTION

Figure 1:
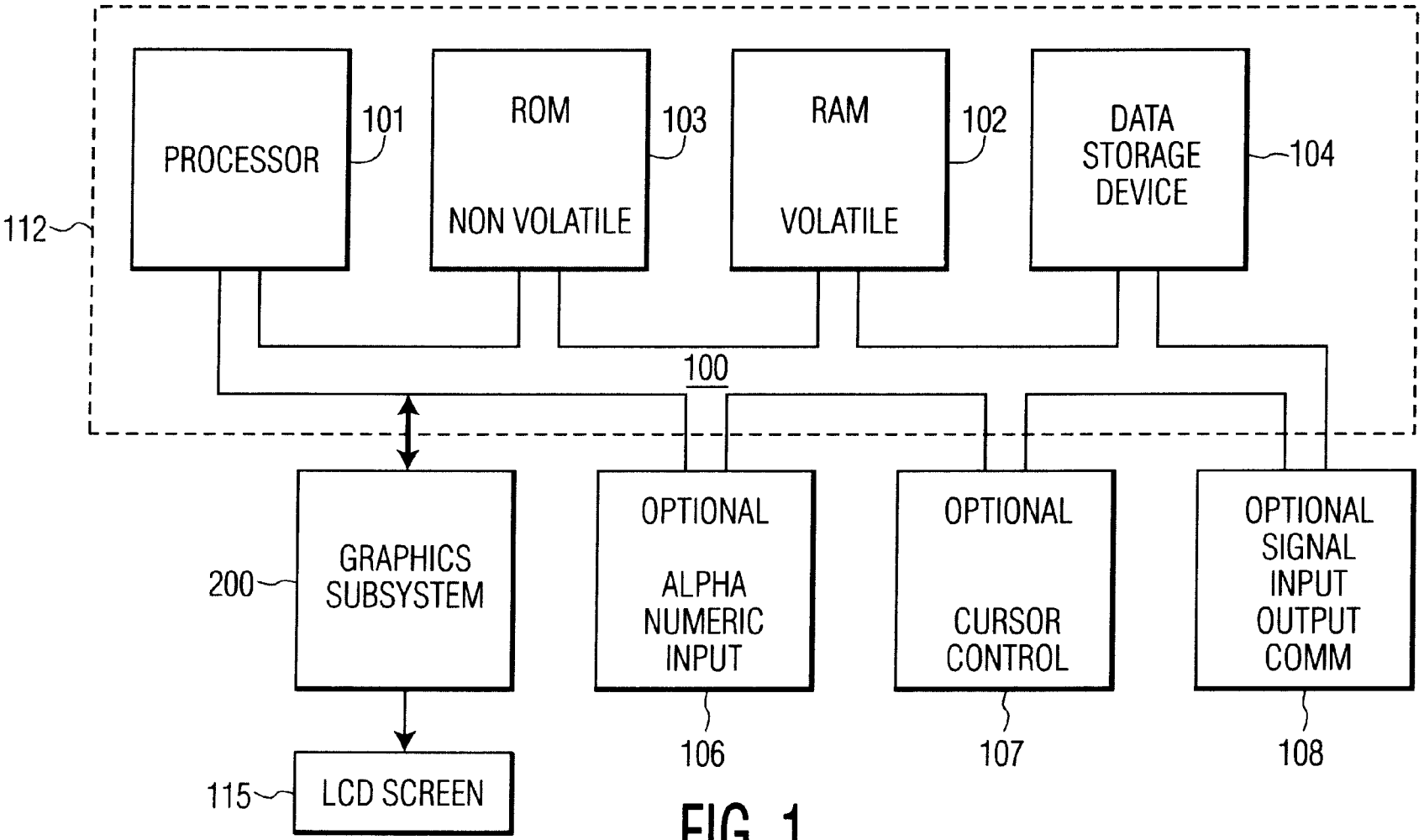
FIG. 1 shows a computer system environment in accordance with one embodiment of the present invention.

Reference will now be made in detail to the preferred embodiments of the invention, flexible color modulation tables of ratios for generating color modulation patterns, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not unnecessarily to obscure aspects of the present invention.

The present invention provides a method and system for modulating intensity of a passive LCD display which avoids the objectionable interference patterns caused by environmental lighting conditions. The present invention provides a solution that can readily control different types of passive LCD displays from different manufacturers. The present invention provides a solution that is readily adaptable to different environmental lighting conditions. Additionally, the present invention provides a large color palette while avoiding those particularly observable interference patterns visible to human eye. The present invention and its benefits are further described below.

Notation and Nomenclature

Some portions of the detailed descriptions which follow are presented in terms of procedures, steps, logic blocks, processing, and other symbolic representations of operations on data bits within a computer memory. These descriptions and representations are the means used by those skilled in the data processing arts to convey most effectively the substance of their work to others skilled in the art. A procedure, computer executed step, logic block, process, etc., are here, and generally, conceived to be self-consistent sequences of steps or instructions leading to a desired result. The steps are those requiring physical manipulations of physical quantities. Usually, though not necessarily, these quantities take the form of electrical or magnetic signals capable of being stored, transferred, combined, compared, and otherwise manipulated in a computer system. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussions, it is appreciated that throughout the present invention, discussions utilizing terms such as "processing," "computing," "sequencing," "generating," "determining," "displaying," "adding," or the like, refer to the action and processes of an electronic computing device, that manipulates and transforms data represented as physical (electronic) quantities within the computer system's registers and memories into other data similarly represented as physical quantities within the computer system registers or memories or other such information storage, transmission, or display devices.

Computer System Environment

Referring to FIG. 1, a computer system 112 is illustrated. Within the following discussions of the present invention, certain processes and steps are discussed that are realized, in one embodiment, as a series of instructions (e.g., software program) that reside within computer readable memory units of computer system 112 and executed by processors of system 112. When executed, the instructions cause the computer system 112 to perform specific actions and exhibit specific behavior which is described in detail as follows.

Additionally, it should be noted that computer system 112 can be implemented as an embedded computer system. Such an implementation can be used to control the operations and provide the functionality of a variety of portable and non-portable electronic devices. Such devices include, for example, hand held portable devices (PDAs, cellphones, etc.) and non-portable devices (set-top boxes, printers, etc.).

In general, computer system 112 with which the present invention functions comprises an address/data bus 100 for communicating information, one or more central processors 101 coupled with bus 100 for processing information and instructions, a computer readable volatile memory unit 102 (e.g., random access memory, static RAM, dynamic RAM, etc.) coupled with bus 100 for storing information and instructions for central processor(s) 101, a computer readable non-volatile memory unit (e.g., read only memory, programmable ROM, flash memory, EPROM, EEPROM, etc.) coupled with bus 100 for storing static information and instructions for central processor(s) 101. System 112 can optionally include a mass storage computer readable data storage device 104, such as a magnetic or optical disk, flash memory device, or the like coupled with bus 100, for storing information and instructions.

Optionally, system 112 can also couple to an alphanumeric input device 106 including alphanumeric and function keys coupled to bus 100 for communicating information and command selections to central processor(s) 101, a cursor control device 107 coupled to the bus for communicating user input information and command selections to central processor(s) 101, and a signal input/output device 108 coupled to bus 100 for communicating messages, command selections, data, etc. to and from central processor(s) 101.

System 112 is coupled to a graphics subsystem 200 which includes the hardware for implementing the modulation of intensity of a passive LCD display in accordance with one embodiment of the present invention. System 200 provides the hardware platform that provides for the configurable control of different types of passive LCD displays, adaptability to different environmental lighting conditions, and the large color palette that avoids visible interference patterns. System 200 is shown coupled to control an LCD screen 115.

Figure 2:
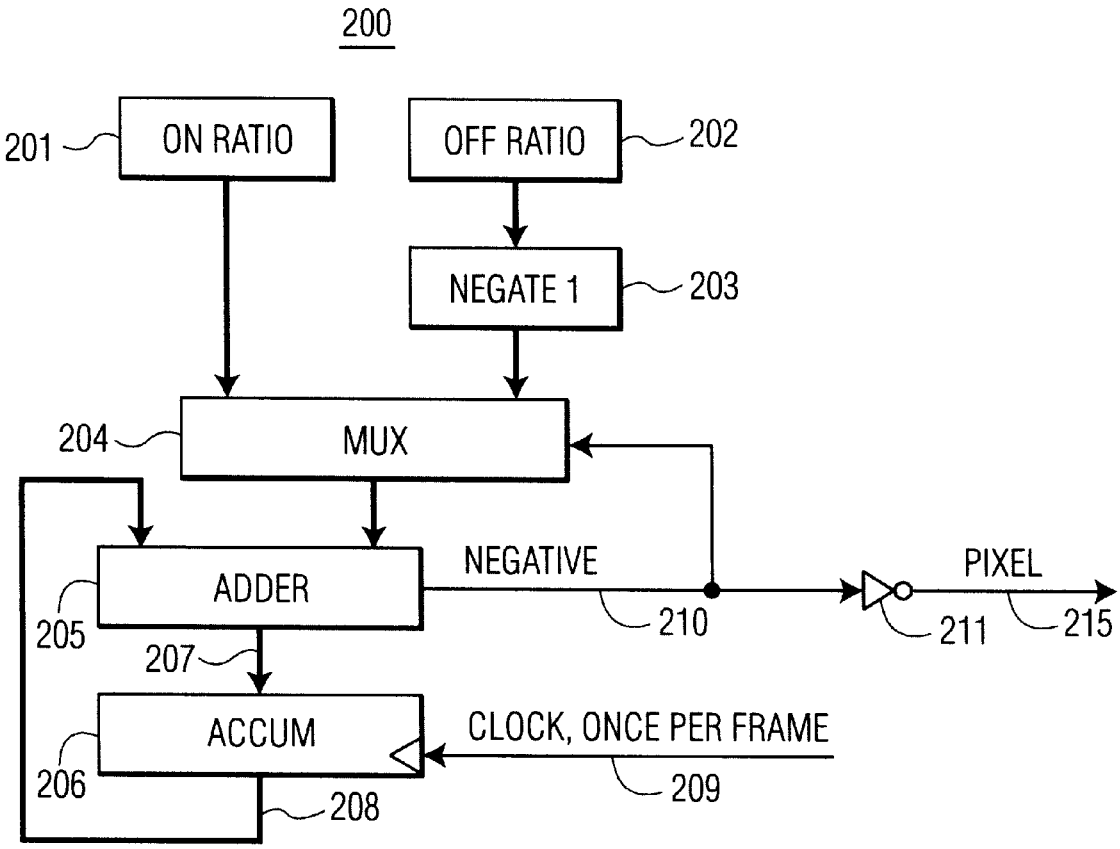
FIG. 2 shows a diagram of a system in accordance with one embodiment of the present invention.

Referring now to FIG. 2, a diagram of the system 200 in accordance with one embodiment of the present invention is shown. As depicted in FIG. 2, system 200 includes an on-ratio unit 201 and an off-ratio unit 202. On-ratio unit 201 is coupled to a multiplexer 204 (hereafter mux 204) and off-ratio unit 202 is coupled to mux 204 via a negate circuit 203. An output of mux 204 is coupled to an adder 205. Adder 205 produces a first output 207 for an accumulator 206, and a second output 210 for controlling mux 204 and for a coupled inverter 211. Inverter 211 produces the output 215 for driving individual pixels of a display (e.g., LCD screen 115). Accumulator 206 is coupled to receive inputs from adder 205 via adder output 207. Accumulator 206 produces an accumulator output 208 that is fed back into adder 205. Accumulator 206 is clocked once per frame by a clock signal 209.

System 200 functions in part by modulating the intensity of a passive LCD display (e.g., LCD screen 115) which avoids the objectionable interference patterns caused by environmental lighting conditions. System 200 controls the intensity of each pixel in the display by sequentially turning the pixel on and off with output 215. As is known by those skilled in the art, pixel intensity (particularly with respect to passive LCD displays) can be controlled by rapidly turning a pixel on and off. Higher intensity is generated by using a higher duty cycle for the pixel and lower intensity is generated by using a lower duty cycle for the pixel. System 200 provides a solution that can readily control different types of passive LCD displays (e.g., from different manufacturers) and is readily adaptable to different environmental lighting conditions. Additionally, system 200 provides a large color palette while avoiding those particularly observable interference patterns visible to human eye.

Referring still to FIG. 2, as described above, system 200 produces a pixel output 215 to implement intensity modulation for a display of an electronic device. When pixel output 215 is asserted, the particular pixel is on. When pixel output 215 is deasserted, the particular pixel is off. In accordance with the present invention, tables of ratios for generating color modulation patterns are used. The ratios include an off ratio and an on ratio for each possible intensity. In system 200, on-ratios are provided by unit 201 and off-ratios are provided by unit 202. A pixel intensity for a pixel is selected by selecting a corresponding intensity value in the table (e.g., instantiated in units 201 and 202). The pixel intensity is implemented by using accumulator 206 having output 208 for determining whether the pixel output 215 is on or off, wherein the pixel output 215 is on for zero and for positive values of the output 208 and off for negative values of the output 208. Pixel output 215 is used to implement a duty cycle for the pixel, by turning the pixel on and off.

It should be noted that each color modulation value, (each color intensity), has a repeat rate that is independent of the other color modulation values. In the present embodiment, the color sequences are generated once per frame. A history of the color modulation values is maintained for subsequent frames using accumulator 206. By ensuring the repeat rate of each color intensity is independent, interference between similar color intensities is minimized.

Referring still to FIG. 2, each color modulation value is selected by selecting two values, the on-ratio and the off-ratio using units 201-202, and successively adding and accumulating these values using adder 205 and accumulator 206 over successive frames. The combination of the on-ratio and the off-ratio set the "period" of an individual color modulation value, where: On_ratio+OFF_ratio=period. For simple ratios, when the on-ratio and off ratio can both evenly divide into the period, the resulting intensity value will repeat the same pattern every period. Some more complex ratios will not repeat identical sequences every period but will produce the desired ratio of "ON" and "OFF" cycles (e.g., the pixel output 215). An example is shown below:

Assume

ONR[n]= on ratio for color modulation n

OFFR[n]= off ratio for color modulation n

ACCUM[n]= accumulator for color modulation n

The accumulator is used to determine if this pixel should be on or off for the next frame.

Assume a simple ratio, with ONR[n]=1, OFFR[n]=2

Further assume that ACCUM[n] is initially=0 A pixel will be on for all 0 and positive values in the accumulator, off for all negative values.

Therefor, PIXEL[n]=ON

During each frame, the values for the next frame are calculated as follows:

If PIXEL[n]=ON
ACCUM[n]=ACCUM[n]−OFFR[n]
else
ACCUM[n]=ACCUM[n]+ONR[n]

In this example, the pixel is on for the first frame, (ACCUM[n]=0). For the second frame, the pixel is on, PIXEL[n]=ON, so the off value is subtracted from the accumulator 206, ACCUM[n]=ACCUM[n]−OFFR[n]. This will set ACCUM[n]=to −2. Subsequent frames will add one, the on ratio, until the ACCUM[n] is=>0. This will take two frames because the ONR[n] is one. This provides a repeating sequence of ON, OFF, OFF, ON, OFF, OFF. Thus, the duty cycle is implemented by setting an initial output of the accumulator 206 and subsequently setting to a value equal to the output minus the off-ratio if the pixel is on, and setting the output to the output plus the on-ratio if the pixel is off. Successively turning the pixel on and off in accordance with the output thereby implements the duty cycle for the pixel according to the on-ratio and off-ratio of the intensity value. In this example, a ⅓on duty cycle is generated. The Table 1 of FIG. 3 shows several more on-ratio off-ratio examples.

Referring now to FIG. 3, a table of intensity values in accordance with one embodiment of the present invention is shown. FIG. 3 depicts Table 1, a table of intensity values as instantiated by system 200 (such as, for example, within memories included within on-ratio unit 201 and off-ratio unit 202). Table 1 shows colors A–F across the top row. The second row from the top shows the respective on-ratio for each of colors A–F. The third row from the top shows the respective off-ratio for each of colors A–F. The fourth row from the top shows the respective period for each of colors A–F. The fifth row from the top labels the respective columns showing the accumulator output (e.g., output 208) and the pixel output (e.g., output 215) that results from that accumulator output.

Thus, as shown in Table 1, the pixel output is generated by the accumulator output, wherein the pixel is on for zero and for positive values of the accumulator output and off for negative values of the accumulator output. The on-ratios and the off-ratios control the duty cycle. As shown in Table 1, color A has a lower intensity (e.g., duty cycle) than color B, and so on, and color F has the highest intensity of the colors A–F.

The programmable nature of Table 1 provides for custom configuring a large color palette to avoid particularly observable interference patterns visible to human eye. The programmable nature of Table 1 allows system 200 to be readily modified to control different types of passive LCD displays from different manufacturers. For example, when an electronic device is modified to use a passive LCD display from a different manufacture, hardware of the graphics subsystem need not be altered. The ratios of the table (e.g., Table 1) can be readily reprogrammed to account for the characteristics of the new passive LCD display. Similarly, the table of ratios provides a solution that is readily adaptable to different environmental lighting conditions. For example, a manufacture need not produce custom versions of an electronic device for selling in different markets around the world. A global manufacturer can standardize the electronic devices, secure in the knowledge that different lighting environments in different markets around the world can be readily accounted for by reprogramming the ratios in the table, thereby avoiding periods that produce visual artifacts.

Referring still to FIG. 3, it should be noted that with a fixed duty cycle, a very finite number of intensities are available. The on ratio and off ratios control the duty cycle. For example, Table 2 below shows a case where all patterns must repeat every 16 frames. The percentages in the second column show the duty cycle for the given number of "on frames" in the first column. In this example, the period is fixed at 16 total frames. However, a much more flexible duty cycle can be achieved with control of both the on-ratios and off-ratios and the length of the period.

TABLE 2

| 16 Frame period | |
|---|---|
| Number of on frames | Percentage on |
| 0 | 0.00% |
| 1 | 6.25% |
| 2 | 12.50% |
| 3 | 18.75% |
| 4 | 25.00% |
| 5 | 31.25% |
| 6 | 37.50% |
| 7 | 43.75% |
| 8 | 50.00% |
| 9 | 56.25% |
| 10 | 62.50% |
| 11 | 68.75% |
| 12 | 75.00% |
| 13 | 81.25% |
| 14 | 87.50% |
| 15 | 93.75% |
| 16 | 100.00% |

Tables 3 through 6 below show the possible percentages, or duty cycles, with periods of 15, 13, 11, and 7 frames.

TABLE 3

| 15 Frame period | |
|---|---|
| Number of on frames | Percentage On |
| 0 | 0.00% |
| 1 | 6.67% |
| 2 | 13.33% |
| 3 | 20.00% |
| 4 | 26.67% |
| 5 | 33.33% |
| 6 | 40.00% |
| 7 | 46.67% |
| 8 | 53.33% |
| 9 | 60.00% |
| 10 | 66.67% |
| 11 | 73.33% |
| 12 | 80.00% |
| 13 | 86.67% |
| 14 | 93.33% |
| 15 | 100.00% |

TABLE 4

| 13 Frame period | |
|---|---|
| Number of on frames | Percentage On |
| 0 | 0.00% |
| 1 | 7.69% |
| 2 | 15.38% |
| 3 | 23.08% |
| 4 | 30.77% |
| 5 | 38.46% |
| 6 | 46.15% |
| 7 | 53.85% |
| 8 | 61.54% |
| 9 | 69.23% |
| 10 | 76.92% |
| 11 | 84.62% |
| 12 | 92.31% |
| 13 | 100.00% |

TABLE 5

| 11 Frame period | |
|---|---|
| Number of on frames | Percentage On |
| 0 | 0.00% |
| 1 | 9.09% |
| 2 | 18.18% |
| 3 | 27.27% |
| 4 | 36.36% |
| 5 | 45.45% |
| 6 | 54.55% |
| 7 | 63.64% |
| 8 | 72.73% |
| 9 | 81.82% |
| 10 | 90.91% |
| 11 | 100.00% |

TABLE 6

| 7 Frame period | |
|---|---|
| Number of on frames | Percentage On |
| 0 | 0.00% |

TABLE 6-continued

| 7 Frame period | |
|---|---|
| Number of on frames | Percentage On |
| 1 | 14.29% |
| 2 | 28.57% |
| 3 | 42.86% |
| 4 | 57.14% |
| 5 | 71.43% |
| 6 | 85.71% |
| 7 | 100.00% |

As is apparent from Tables 3–6, the ability to control the period as well as the duty cycle adds a significant number of additional possible intensities. For example, in a typical implementation, the present invention is nominally used with on-ratios and off-ratios of 4 bits, providing counts up to 16 and periods up to 32 states, as shown in Table 7 of FIG. 4. This would provide for 32 combinations of on and off periods for the various duty cycles, or 2.63131E+35 possible values. Many of the values are the same, but a very close match can be found for almost any value. This allows the non-linear behavior of an LCD and human vision to be more closely correlated, providing a shading that is a much closer visually linear approximation than could be achieved with a conventional linear response. Patterns may be selected that avoid interference and visual artifacts.

Referring now to FIG. 4, a table showing the percentages (e.g., duty cycles) available to an embodiment of the present invention that controls both the period and the on-ratios and off-ratios is shown. As is apparent from Table 7, the ability to control the period as well as the duty cycle adds a significant number of additional intensities. Table 7 shows percentages up to 50%.

It should be noted that the present embodiment creates a single on-off value for each color once per frame. It is sometimes desirable to be able to have adjacent pixels of the same shade to use different offsets into the color sequence. In order to enable this function, a history of the pixel values can be maintained, allowing different pixels to offset into the history at different depths. It is only necessary that each pixel uses a constant offset into the history and all pixels of a given shade will display, over a sequence of frames, the same shade. This technique will minimize pulsing on the display. A diagram of a system for implementing the history function is shown in FIG. 5 below.

Figure 5:
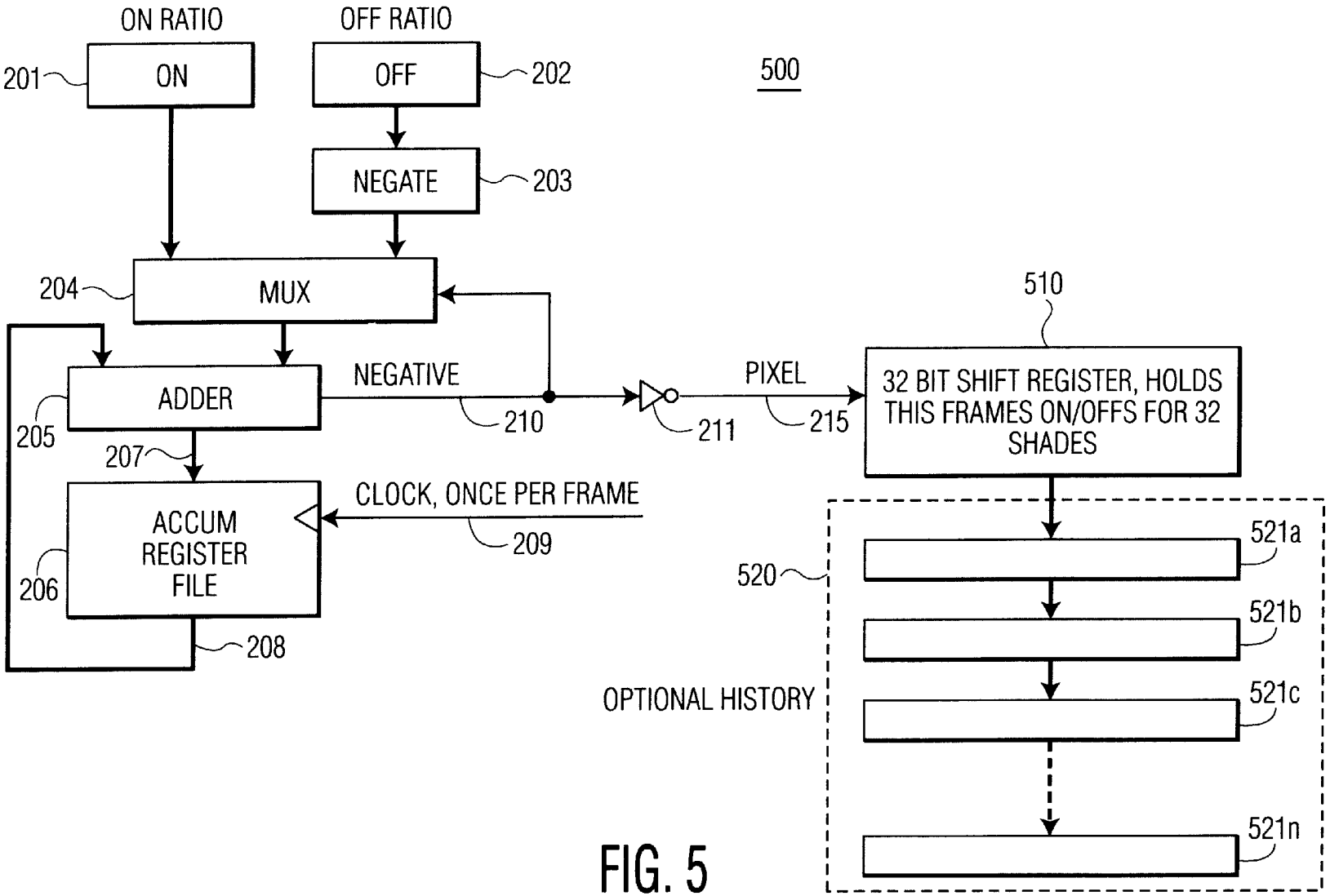
FIG. 5 shows a diagram of a system in accordance with an alternative embodiment of the present invention.

FIG. 5 shows a diagram of a system 500 in accordance with one embodiment of the present invention. System 500 implements a history function for the pixel output to generate offsets in the pixel output sequences. As depicted in FIG. 5, system 500 is substantially similar to system 200 of FIG. 2. System 500 adds a 32 bit shift register 510. Shift register 510 generates a history 520 of pixel output values 521*a*–521*n* as received via pixel output 215. The use of shift register 510 allows different pixels to offset into history file 520 at different depths, thereby allowing adjacent pixels of the same shade to use different offsets into the color sequence.

Figure 6:
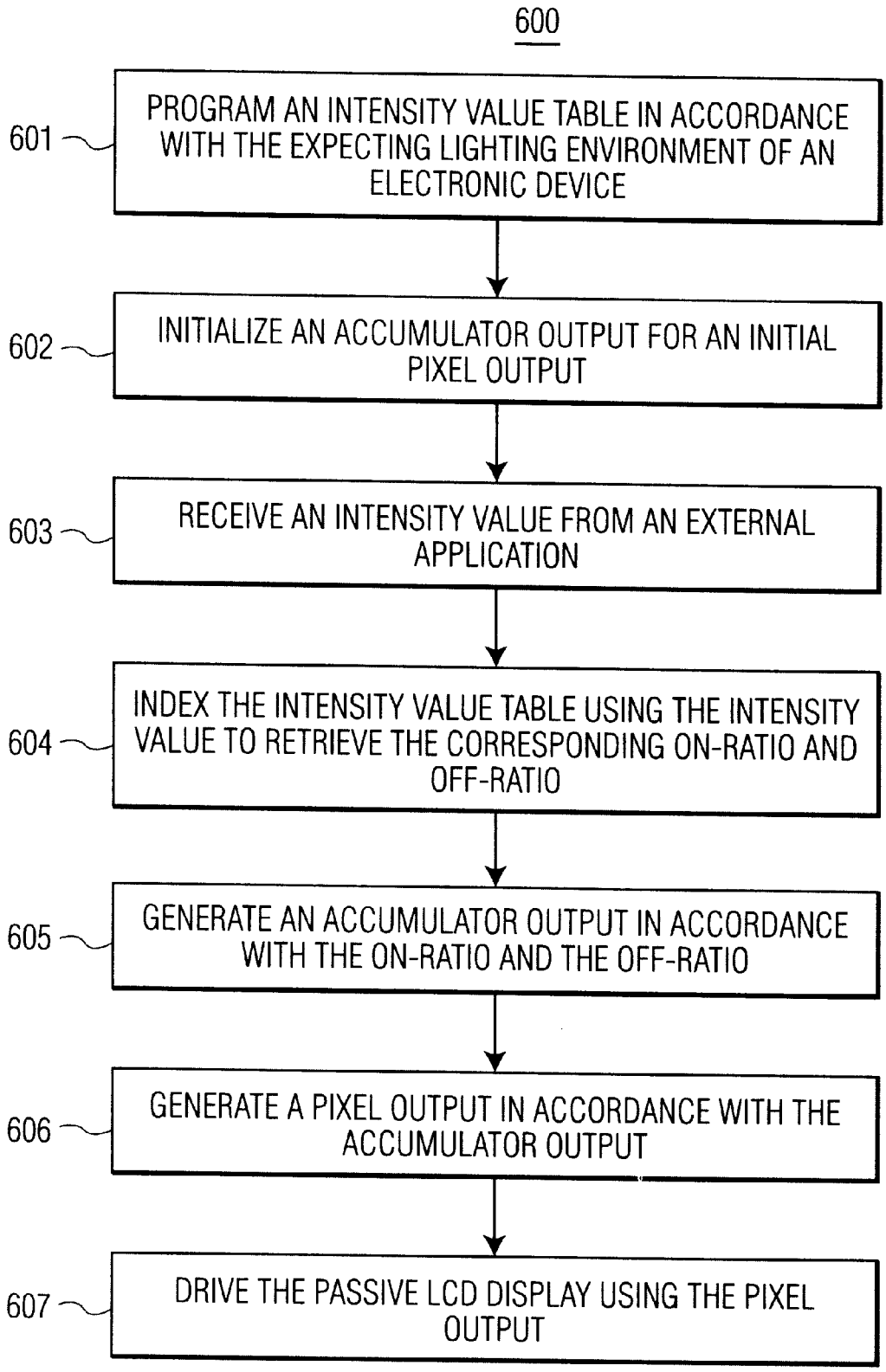
FIG. 6 shows a flow chart of the steps of an operating process of a pixel intensity modulation system in accordance with one embodiment of the present invention.

Referring now to FIG. 6, a flow chart of the steps of a process 600 in accordance with one embodiment of the present invention is shown. As shown in FIG. 6, process 600 depicts the operating steps of a graphics subsystem (e.g., system 200 of FIG. 2) generating outputs to drive a passive LCD display (e.g.,.

Process 600 begins in step 601, where engineers program an intensity value table in accordance with the expected lighting environment of an electronic device. As described above, many variables affect the quality of the passive LCD display. One primary variable is the lighting environment the devices expected to be used in, particularly, for example, the flicker rate of overhead office lights.

In step 602, the output of the accumulator (e.g., accumulator 206 of FIG. 6) is initialized to an initial value for an initial pixel output (e.g., pixel output 215).

In step 603, the graphics subsystem commences normal operation by accepting an intensity value from, for example, an external application.

In step 604, the intensity value from the external application is used index the intensity value table and to retrieve the corresponding on-ratio and off-ratio. As described above, the intensity (or gray scale) for a given pixel is determined by the duty cycle at which the pixel is turned on and off. For example, over a period of 32 frames, each pixel will sequence through a given on-off duty cycle to implement their respective intensities.

In step 605, the accumulator output is generated by successively adding the on-ratio and the off-ratio.

In step 606, the resulting accumulator output is coupled to generate a pixel output drive the passive LCD display.

In step 607, the pixel of the passive LCD display is driven using the pixel output. By sequencing through each pixel of the display, the pixel output is able to drive the entire display, thereby generating an image in accordance with the information received from the external application.

Thus, the present invention provides a method and system for modulating intensity of a passive LCD display which avoids the objectionable interference patterns caused by environmental lighting conditions. The present invention provides a solution that can readily control different types of passive LCD displays from different manufacturers. The present invention provides a solution that is readily adaptable to different environmental lighting conditions. Additionally, the present invention provides a large color palette while avoiding those particularly observable interference patterns visible to the human eye.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order best to explain the principles of the invention and its practical application, thereby to enable others skilled in the art best to utilize the invention and various embodiments with various modifications as are suited to the particular use contemplated. It is intended that the scope of the invention be defined by the claims appended hereto and their equivalents.

What is claimed is:

1. A method for providing intensity modulation for a display of an electronic device, the method comprising the steps of:

a) defining a table of intensity values, each intensity value including a respective on-ratio and a respective off-ratio;

b) selecting a pixel intensity for a pixel of a display by selecting a corresponding intensity value in the table; and c) implementing the pixel intensity by using an accumulator, the accumulator having an output for determining whether the pixel is on or off, wherein the pixel is on for zero and for positive values of the output and off for negative values of the output, and wherein the output is used to implement a duty cycle for the pixel by:

c1) setting an initial output of the accumulator;

c2) setting the output to the output minus the off-ratio if the pixel is on; and c3) setting the output to the output plus the on-ratio if the pixel is off, thereby implementing a duty cycle for the pixel according to the on-ratio and off-ratio of the intensity value.

2. The method of claim 1 wherein step b) further includes the step of:

receiving the pixel intensity from an application executing on the electronic device and selecting the corresponding pixel intensity value in the table.

3. The method of claim 1 wherein step a) further includes the steps of:

defining an on-ratio table using an on-ratio unit; and defining an off-ratio table using an off-ratio unit.

4. The method of claim 3 further including the step of:

providing the on-ratio and the off-ratio to the accumulator via the on-ratio unit and the off-ratio unit.

5. The method of claim 1 wherein step a) further includes the step of:

defining the table of intensity values, each intensity value including a respective period.

6. The method of claim 1 wherein the display is a passive LCD (liquid crystal display) type display.

7. The method of claim 1 further including the step of:

maintaining a history of the accumulator output using a shift register.

8. A system for providing intensity modulation for a display of an electronic device, comprising:

a memory storing a table of intensity values, each intensity value including a respective on-ratio and a respective off-ratio, the memory coupled to receive a pixel intensity from an external application, wherein the pixel intensity is for a pixel of a display and is configured to select a corresponding intensity value in the table; and an accumulator for implementing the pixel intensity, the accumulator coupled to the memory and having an output for determining whether the pixel is on or off, wherein the pixel is on for zero and for positive values of the output and off for negative values of the output, and wherein the output is used to implement a duty cycle for the pixel by:

c1) setting an initial output of the accumulator;

c2) setting the output to the output minus the off-ratio if the pixel is on; and c3) setting the output to the output plus the on-ratio if the pixel is off, thereby implementing a duty cycle for the pixel according to the on-ratio and off-ratio of the intensity value.

9. The system of claim 8 wherein the memory further comprises:

an on-ratio unit for defining an on-ratio table; and off-ratio unit for defining an off-ratio table, the on-ratio table and the off-ratio table implementing the table of intensity values.

10. The system of claim 9 wherein the on-ratio and the off-ratio are provided to the accumulator via the on-ratio unit and the off-ratio unit respectively.

11. The system of claim 8 wherein the table of intensity values each include a respective period.

12. The system of claim 8 wherein the display is a passive LCD (liquid crystal display) type display.

13. The system of claim 8 further comprising a shift register for maintaining a history of the accumulator output.

14. The system of claim 13 wherein the history of the accumulator output is used to generate an offset for similar intensities to avoid interference on the display.

15. A method for providing gray scale intensity modulation for a passive LCD display of a digital electronic device, the method comprising the steps of:

a) defining a table of intensity values, each intensity value including a respective on-ratio and a respective off-ratio;

b) selecting a pixel intensity for a pixel of a display by selecting a corresponding intensity value in the table;

c) implementing the pixel intensity by using an accumulator, the accumulator having an output for determining whether the pixel is on or off, wherein the pixel is on for zero and for positive values of the output and off for negative values of the output, and wherein the output is used to implement a duty cycle for the pixel by:

c1) setting an initial output of the accumulator;

c2) setting the output to the output minus the off-ratio if the pixel is on;

c3) setting the output to the output plus the on-ratio if the pixel is off, thereby implementing a duty cycle for the pixel according to the on-ratio and off-ratio of the intensity value; and d) maintaining a history of the accumulator output using a shift register, wherein the history is used to generate an offset for similar intensities implemented by the accumulator to avoid interference on the display.

16. The method of claim 15 wherein step b) further includes the step of:

receiving the pixel intensity from a software application executing on the digital electronic device and selecting the corresponding pixel intensity value in the table.

17. The method of claim 15 wherein step a) further includes the steps of:

defining an on-ratio table using an on-ratio unit; and defining an off-ratio table using an off-ratio unit.

18. The method of claim 17 further including the step of:

providing the on-ratio and the off-ratio to the accumulator via the on-ratio unit and the off-ratio unit.

19. The method of claim 15 wherein step a) further includes the step of:

defining the table of intensity values, each intensity value including a respective period.

20. The method of claim 15 further including the step of:

selecting the on-ratio for the accumulator or the off-ratio for the accumulator by using a multiplexer coupled to the accumulator.

* * * * *